US008146184B2

(12) United States Patent
Lin

(10) Patent No.: US 8,146,184 B2
(45) Date of Patent: Apr. 3, 2012

(54) INFLATABLE CUSHION HAVING A WARMING FUNCTION

(75) Inventor: Ping-Ting Lin, Taichung Hsien (TW)

(73) Assignee: Feng Yi Outdoor Leisure Equipment Enterprise Co., Ltd., Taichung Hsien (TW)

( * ) Notice: Subject to any disclaimer, the term of this patent is extended or adjusted under 35 U.S.C. 154(b) by 87 days.

(21) Appl. No.: 12/618,835

(22) Filed: Nov. 16, 2009

(65) Prior Publication Data

US 2011/0113551 A1 May 19, 2011

(51) Int. Cl.
*A47C 27/22* (2006.01)

(52) U.S. Cl. ..... 5/417; 5/710; 5/711

(58) Field of Classification Search ..... 5/710, 711, 5/709, 417, 714, 715
See application file for complete search history.

(56) References Cited

U.S. PATENT DOCUMENTS

| | | | | |
|---|---|---|---|---|
| 2,748,401 | A * | 6/1956 | Winstead | 5/711 |
| 2,887,692 | A * | 5/1959 | Gosman | 5/711 |
| 3,988,791 | A * | 11/1976 | Simon | 5/413 R |
| 4,167,795 | A * | 9/1979 | Lambert, Jr. | 5/711 |
| 5,388,292 | A * | 2/1995 | Stinson et al. | 5/711 |
| 6,216,299 | B1 * | 4/2001 | Kohlman | 5/713 |
| 7,353,555 | B2 * | 4/2008 | Lau | 5/711 |
| 7,914,611 | B2 * | 3/2011 | Vrzalik et al. | 5/714 |
| 2004/0123393 | A1 * | 7/2004 | Wang | 5/711 |
| 2007/0006385 | A1 * | 1/2007 | Davis | 5/710 |
| 2007/0124864 | A1 * | 6/2007 | Lau | 5/711 |
| 2009/0106907 | A1 * | 4/2009 | Chambers | 5/709 |

* cited by examiner

*Primary Examiner* — Robert G Santos
*Assistant Examiner* — Brittany Wilson
(74) *Attorney, Agent, or Firm* — Alan Kamrath; Kamrath IP Lawfirm, PA

(57) ABSTRACT

An inflatable cushion includes a cushion body and an air nozzle mounted on the cushion body. The cushion body includes an upper surface layer, a lower surface layer combined with the upper surface layer, a flexible pull strap mounted between the upper surface layer and the lower surface layer, and a warming layer mounted on the pull strap and located between the upper surface layer and the lower surface layer. Thus, the upper surface layer and the lower surface layer are isolated by the warming layer and the pull strap to prevent moisture of the ground from being infiltrated through the lower surface layer into the upper surface layer so that the cushion body has a warming effect.

17 Claims, 5 Drawing Sheets

INFLATABLE CUSHION HAVING A WARMING FUNCTION

BACKGROUND OF THE INVENTION

1. Field of the Invention

The present invention relates to a cushion and, more particularly, to an inflatable cushion for camping, mountaineering and the like.

2. Description of the Related Art

A conventional inflatable cushion in accordance with the prior art shown in FIGS. 4 and 5 comprises a cushion body 40 and an air nozzle 47 mounted on the cushion body 40. The cushion body 40 includes an upper surface layer 41, a lower surface layer 42 combined with the upper surface layer 41, a plurality of pull straps 45 mounted between the upper surface layer 41 and the lower surface layer 42, an upper plastic film layer 43 mounted on an inner wall of the upper surface layer 41, and a lower plastic film layer 44 mounted on an inner wall of the lower surface layer 42 and combined with the upper plastic film layer 43. The pull straps 45 are parallel with each other to form a plurality of air channels 46 between the upper surface layer 41 and the lower surface layer 42. In use, when the air nozzle 47 is opened, the ambient air is introduced through the air nozzle 47 into the cushion body 40 so that the air flows through the air channels 46 of the cushion body 40 to inflate and expand the cushion body 40 for use with a user. Thus, the cushion body 40 can be used outdoors for camping, mountaineering and the like. However, the cushion body 40 does not have a warming effect so that when a user lies on the upper surface layer 41 of the cushion body 40, the moisture of the ground or earth will be infiltrated through the lower surface layer 42 into the upper surface layer 41, thereby causing an uncomfortable sensation to the user.

BRIEF SUMMARY OF THE INVENTION

In accordance with the present invention, there is provided a inflatable cushion, comprising a cushion body including an upper surface layer, a lower surface layer combined with the upper surface layer, a flexible pull strap mounted between the upper surface layer and the lower surface layer, and a warming layer mounted on the pull strap and located between the upper surface layer and the lower surface layer.

The primary objective of the present invention is to provide an inflatable cushion having a warming function.

According to the primary objective of the present invention, the cushion body includes a warming layer mounted on the pull strap to provide a warming function.

According to another objective of the present invention, the upper surface layer and the lower surface layer are isolated by the warming layer and the pull strap to prevent the moisture of the ground or earth from being infiltrated through the lower surface layer into the upper surface layer so that the cushion body has a warming effect to the user when the user lies on the upper surface layer of the cushion body.

According to a further objective of the present invention, the warming layer includes a plurality of upper warming portions and a plurality of lower warming portions to enhance the warming effect of the cushion body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
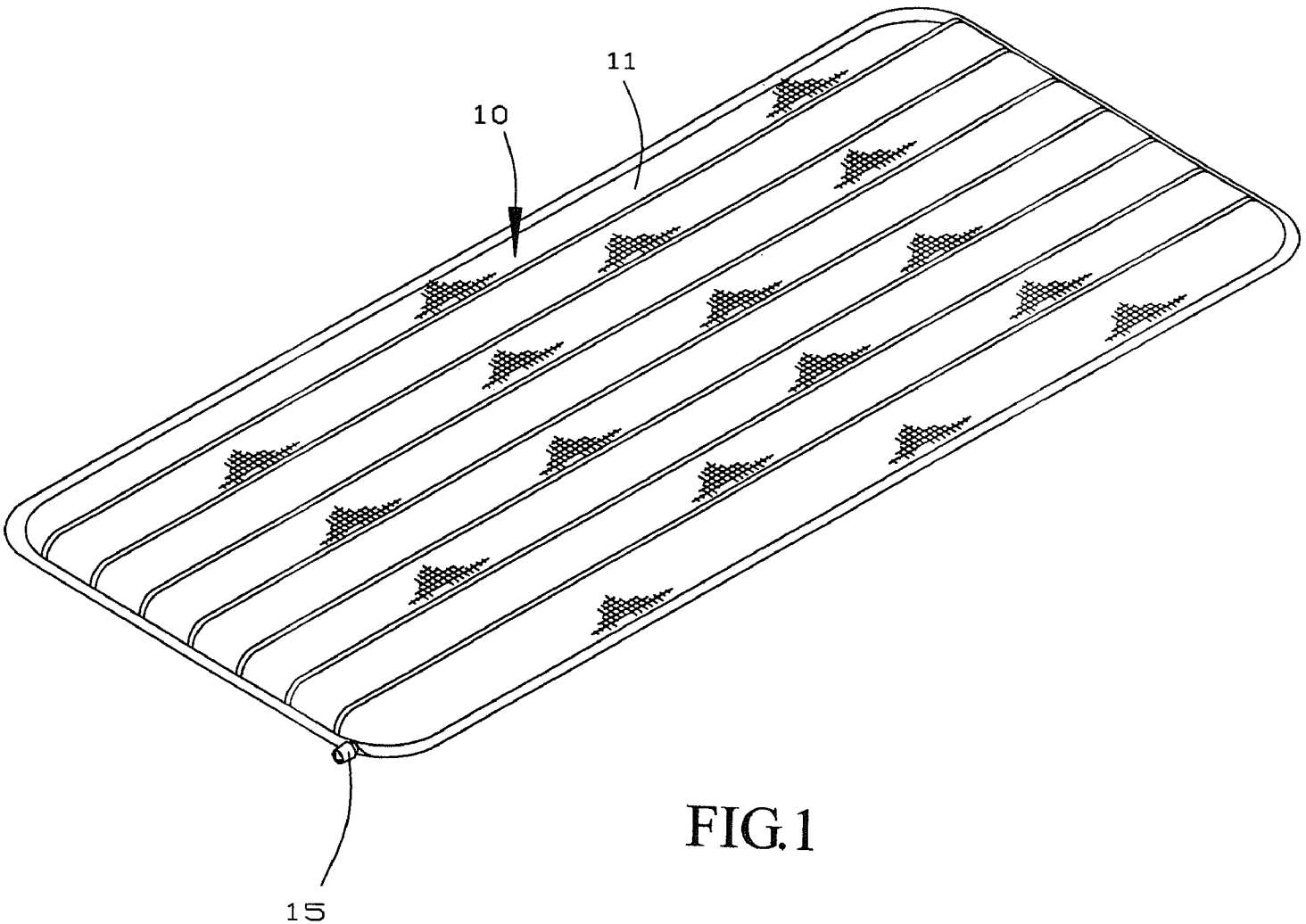
FIG. 1 is a perspective view of an inflatable cushion in accordance with the preferred embodiment of the present invention.
Figure 2:
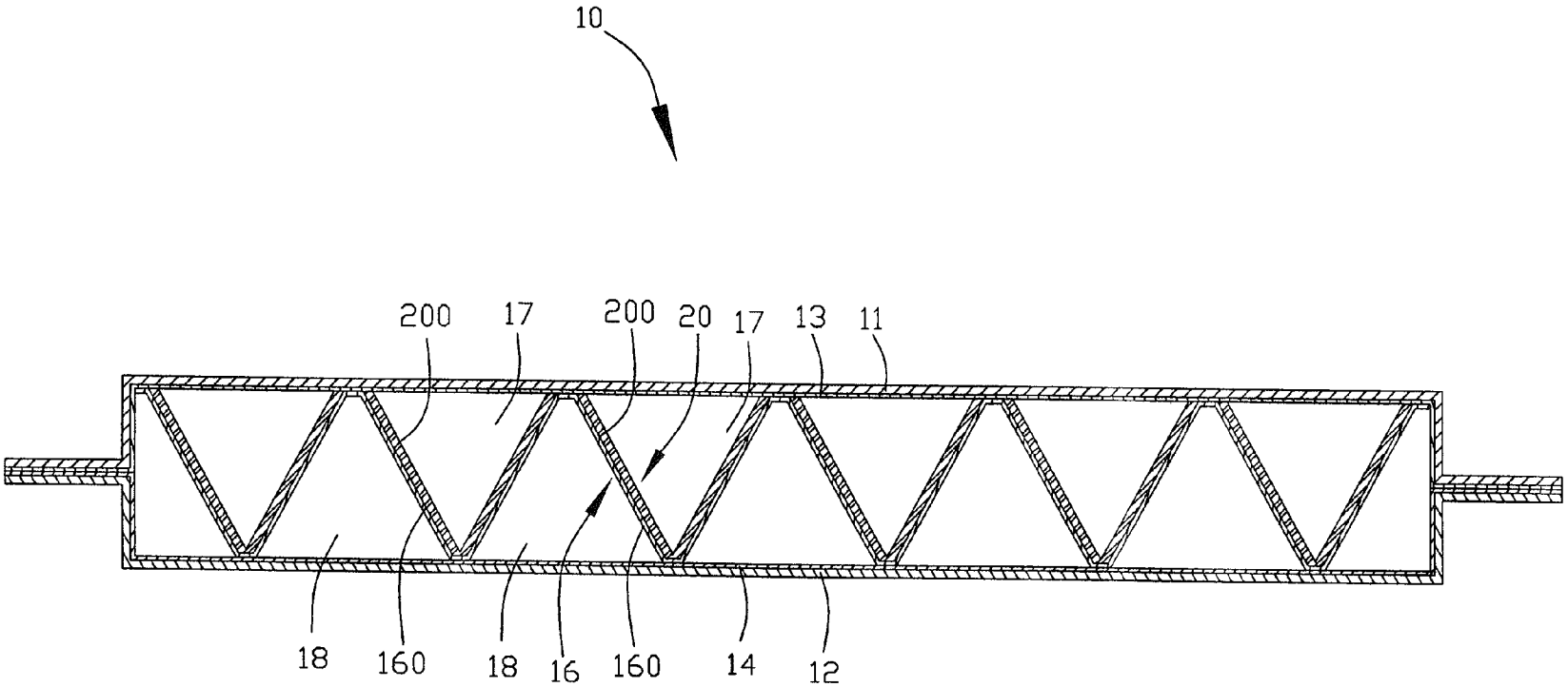
FIG. 2 is a side cross-sectional view of the inflatable cushion as shown in FIG. 1.

Referring to the drawings and initially to FIGS. 1 and 2, an inflatable cushion in accordance with the preferred embodiment of the present invention comprises a cushion body 10 and an air nozzle 15 mounted on the cushion body 10.

The cushion body 10 includes an upper surface layer 11, a lower surface layer 12 combined with the upper surface layer 11, a flexible pull strap 16 mounted between the upper surface layer 11 and the lower surface layer 12, and a warming layer 20 mounted on the pull strap 16 and located between the upper surface layer 11 and the lower surface layer 12. The cushion body 10 further includes an upper plastic film layer 13 mounted on an inner wall of the upper surface layer 11, and a lower plastic film layer 14 mounted on an inner wall of the lower surface layer 12 and combined with the upper plastic film layer 13.

Each of the upper plastic film layer 13 and the lower plastic film layer 14 is made of an air impermeable plastic material, such as a thermoplastic urethane (TPU) and the like. The upper plastic film layer 13 and the lower plastic film layer 14 are sealed and combined together by bonding.

The pull strap 16 is made of a plastic material, such as a thermoplastic urethane (TPU) and the like. The pull strap 16 is located between the upper plastic film layer 13 and the lower plastic film layer 14. The pull strap 16 has a successive bent shape and includes a plurality of bent sections 160 which are connected with each other successively to form a plurality of upper air channels 17 and a plurality of lower air channels 18 between the upper surface layer 11 and the lower surface layer 12. Each of the bent sections 160 of the pull strap 16 has a substantially V-shaped profile and has an upper portion bonded onto the upper surface layer 11 and a lower portion bonded onto the lower surface layer 12. Each of the upper air channels 17 between the upper surface layer 11 and the lower surface layer 12 has a substantially V-shaped profile. Each of the lower air channels 18 between the upper surface layer 11 and the lower surface layer 12 has a substantially inverted V-shaped profile. The upper air channels 17 and the lower air channels 18 are arranged in a staggered manner and are isolated from each other by the pull strap 16.

The warming layer 20 is made of a heat absorbing material, such as a synthetic cotton and the like. The warming layer 20 is located between the upper plastic film layer 13 and the lower plastic film layer 14. Preferably, the warming layer 20 is located between the upper surface layer 11 and the pull strap 16, and the pull strap 16 is located between the warming layer 20 and the lower surface layer 12 so that the upper surface layer 11 and the lower surface layer 12 are isolated by the warming layer 20 and the pull strap 16. The warming layer 20 includes a plurality of upper warming portions 200 each mounted on a respective one of the bent sections 160 of the pull strap 16 and each received in a respective one of the upper air channels 17. The upper warming portions 200 of the warming layer 20 are isolated from each other by the pull strap 16. Each of the upper warming portions 200 of the warming layer 20 has a substantially V-shaped profile and is located between the upper surface layer 11 and the respective bent section 160 of the pull strap 16.

In use, when the air nozzle 15 is opened, the ambient air is introduced through the air nozzle 15 into the cushion body 10 so that the air flows through the upper air channels 17 and the lower air channels 18 of the cushion body 10 to inflate and expand the cushion body 10 for use with a user. In such a manner, the upper surface layer 11 and the lower surface layer 12 are isolated by the warming layer 20 and the pull strap 16 to prevent the moisture of the ground or earth from being infiltrated through the lower surface layer 12 into the upper surface layer 11 so that the cushion body 10 has a warming effect to the user when the user lies on the upper surface layer 11 of the cushion body 10.

Figure 3:
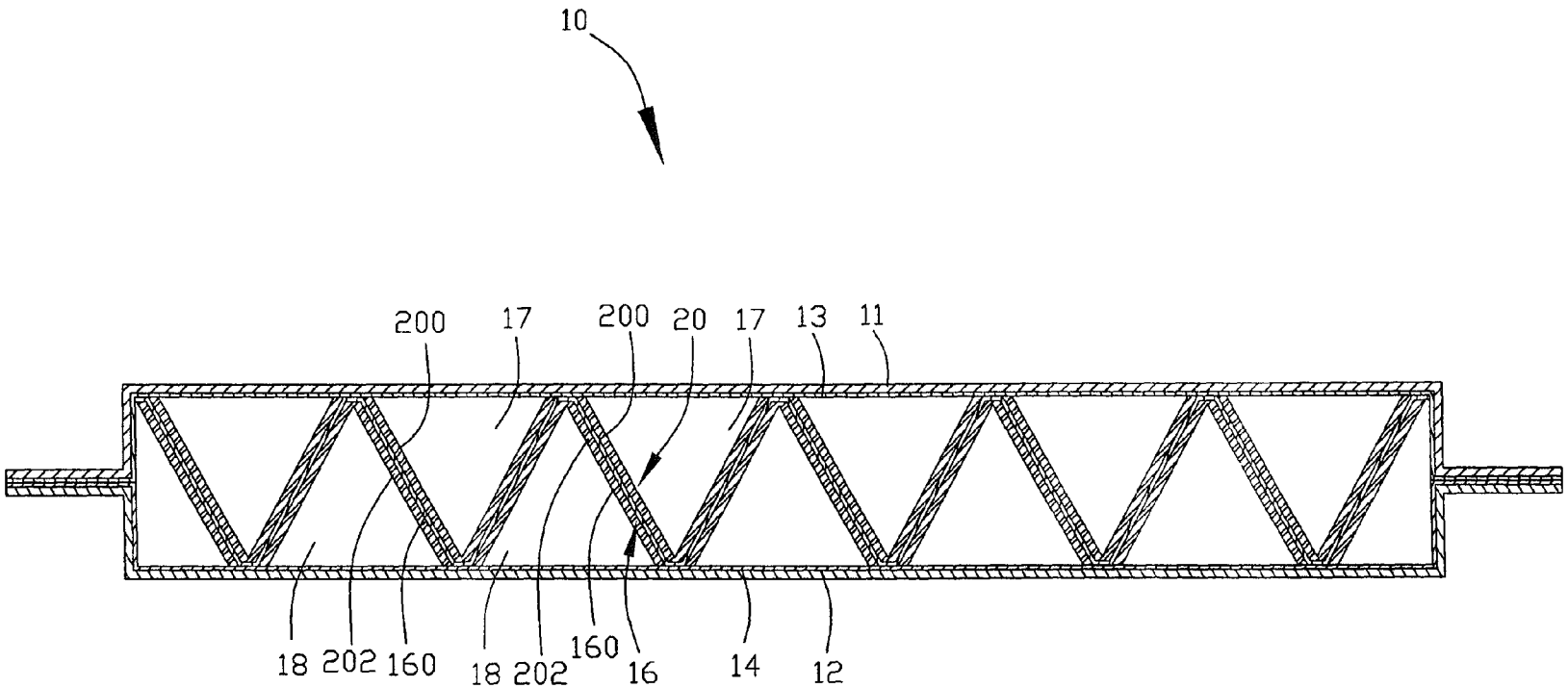
FIG. 3 is a side cross-sectional view of an inflatable cushion in accordance with another preferred embodiment of the present invention.
Figure 4:
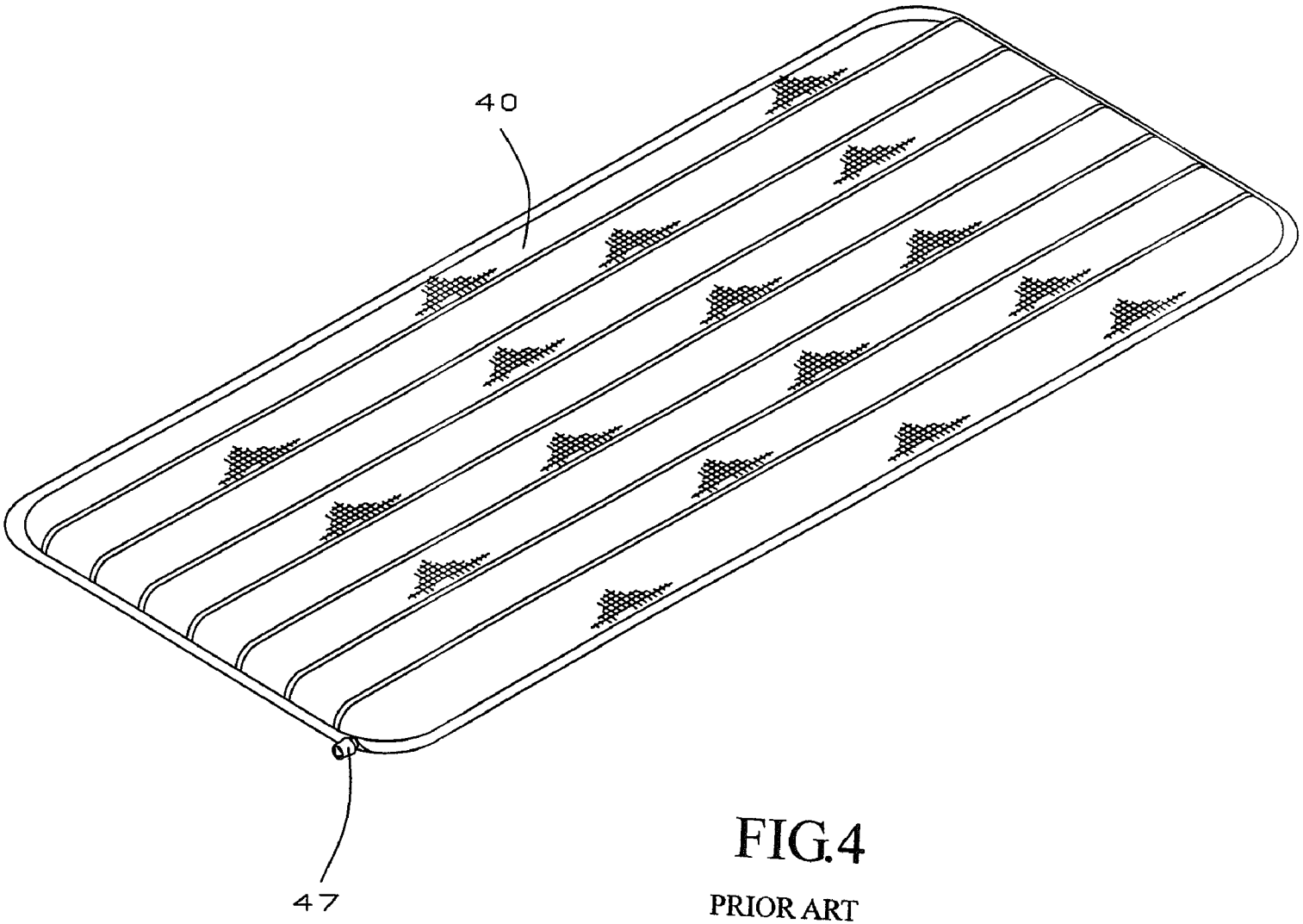
FIG.4 PRIOR ART
FIG. 4 is a perspective view of a conventional inflatable cushion in accordance with the prior art.
Figure 5:
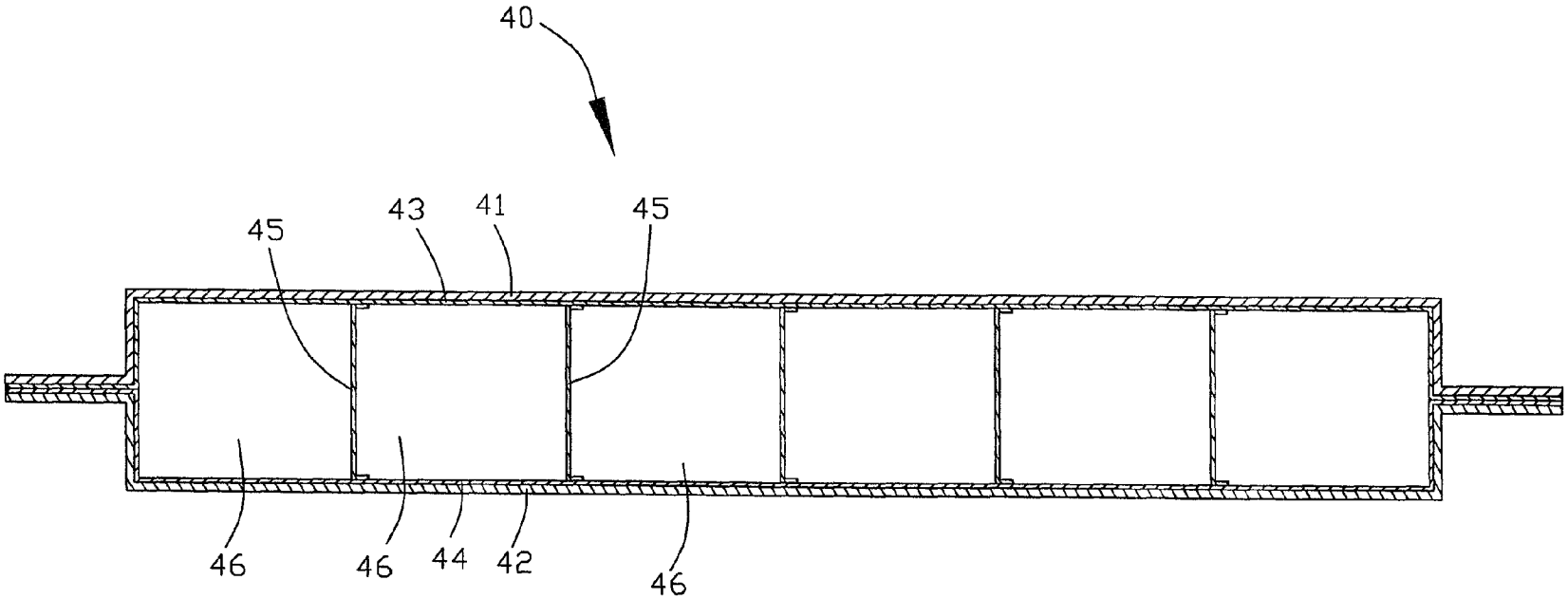
FIG.5 PRIOR ART
FIG. 5 is a side cross-sectional view of the conventional inflatable cushion as shown in FIG. 4.

Referring FIG. 3, the warming layer 20 further includes a plurality of lower warming portions 202 each mounted on a respective one of the bent sections 160 of the pull strap 16 and each received in a respective one of the lower air channels 18. The lower warming portions 202 of the warming layer 20 are isolated from each other by the pull strap 16. Each of the lower warming portions 202 of the warming layer 20 has a substantially inverted V-shaped profile and is located between the lower surface layer 12 and the respective bent section 160 of the pull strap 16. The upper warming portions 200 and the lower warming portions 202 of the warming layer 20 are arranged in a staggered manner and are isolated by the bent sections 160 of the pull strap 16.

Accordingly, the cushion body 10 includes a warming layer 20 mounted on the pull strap 16 to provide a warming function. In addition, the upper surface layer 11 and the lower surface layer 12 are isolated by the warming layer 20 and the pull strap 16 to prevent the moisture of the ground or earth from being infiltrated through the lower surface layer 12 into the upper surface layer 11 so that the cushion body 10 has a warming effect to the user when the user lies on the upper surface layer 11 of the cushion body 10. Further, the warming layer 20 includes a plurality of upper warming portions 200 and a plurality of lower warming portions 202 to enhance the warming effect of the cushion body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An inflatable cushion, comprising:

a cushion body including:

an upper surface layer;

a lower surface layer combined with the upper surface layer;

a flexible pull strap mounted between the upper surface layer and the lower surface layer; and a warming layer rested on a surface of the pull strap and located between the upper surface layer and the lower surface layer;

wherein the pull strap has a successive bent shape;

the pull strap includes a plurality of bent sections which are connected with each other successively to form a plurality of upper air channels and a plurality of lower air channels between the upper surface layer and the lower surface layer;

the cushion body further includes:

an upper plastic film layer mounted on an inner wall of the upper surface layer; and a lower plastic film layer mounted on an inner wall of the lower surface layer and combined with the upper plastic film layer;

the upper plastic film layer and the upper surface layer form two different layers;

the lower plastic film layer and the lower surface layer form two different layers.

2. The inflatable cushion of claim 1, wherein each of the bent sections of the pull strap has a substantially V-shaped profile;

each of the upper air channels between the upper surface layer and the lower surface layer has a substantially V-shaped profile;

each of the lower air channels between the upper surface layer and the lower surface layer has a substantially inverted V-shaped profile.

3. The inflatable cushion of claim 2, wherein each of the bent sections of the pull strap has an upper portion bonded onto the upper surface layer and a lower portion bonded onto the lower surface layer.

4. The inflatable cushion of claim 1, wherein the upper air channels and the lower air channels are arranged in a staggered manner.

5. The inflatable cushion of claim 1, wherein the upper air channels and the lower air channels are isolated from each other by the pull strap.

6. The inflatable cushion of claim 1, wherein the warming layer is located between the upper surface layer and the pull strap;

the pull strap is located between the warming layer and the lower surface layer;

the upper surface layer and the lower surface layer are isolated by the warming layer and the pull strap.

7. The inflatable cushion of claim 1, wherein the warming layer includes a plurality of upper warming portions each mounted on a respective one of the bent sections of the pull strap and each received in a respective one of the upper air channels.

8. The inflatable cushion of claim 7, wherein the upper warming portions of the warming layer are isolated from each other by the pull strap.

9. The inflatable cushion of claim 7, wherein each of the bent sections of the pull strap has a substantially V-shaped profile;

each of the upper warming portions of the warming layer has a substantially V-shaped profile.

10. The inflatable cushion of claim 7, wherein each of the upper warming portions of the warming layer is located between the upper surface layer and the respective bent section of the pull strap.

11. The inflatable cushion of claim 7, wherein the warming layer further includes a plurality of lower warming portions each mounted on a respective one of the bent sections of the pull strap and each received in a respective one of the lower air channels.

12. The inflatable cushion of claim 11, wherein the lower warming portions of the warming layer are isolated from each other by the pull strap.

13. The inflatable cushion of claim 11, wherein each of the bent sections of the pull strap has a substantially V-shaped profile;

each of the lower warming portions of the warming layer has a substantially inverted V-shaped profile.

14. The inflatable cushion of claim 11, wherein each of the lower warming portions of the warming layer is located between the lower surface layer and the respective bent section of the pull strap.

15. The inflatable cushion of claim 11, wherein the upper warming portions and the lower warming portions of the warming layer are arranged in a staggered manner;

the upper warming portions and the lower warming portions of the warming layer are isolated by the bent sections of the pull strap.

16. The inflatable cushion of claim 1, wherein the pull strap is located between the upper plastic film layer and the lower plastic film layer.

17. The inflatable cushion of claim 1, wherein the warming layer is located between the upper plastic film layer and the lower plastic film layer.

* * * * *